United States Patent [19]

Detweiler

[11] Patent Number: 4,464,310

[45] Date of Patent: Aug. 7, 1984

[54] INSULATED CAP AND HEAT SINK FOR AUTOMATIC CHOKE CONTROL

[75] Inventor: Charles A. Detweiler, Durand, Mich.

[73] Assignee: Tom McGuane Industries, Inc., Madison Heights, Mich.

[21] Appl. No.: 423,461

[22] Filed: Sep. 24, 1982

[51] Int. Cl.[3] ..... F02M 1/12
[52] U.S. Cl. ..... 261/39 E
[58] Field of Search ..... 261/39 E, 39 B

[56] References Cited

U.S. PATENT DOCUMENTS

| | | | |
|---|---|---|---|
| 4,038,955 | 8/1977 | Paulmier | 261/39 E |
| 4,050,427 | 9/1977 | Hollins | 261/39 E |
| 4,083,336 | 4/1978 | Armstrong | 261/39 E |
| 4,151,499 | 4/1979 | Ganowsky et al. | 261/39 B |
| 4,218,406 | 8/1980 | Detweiler | 261/39 B |
| 4,237,077 | 12/1980 | Berg | 261/39 E |

FOREIGN PATENT DOCUMENTS

| | | | |
|---|---|---|---|
| 779931 | 7/1957 | United Kingdom | 261/39 B |
| 913173 | 12/1962 | United Kingdom | 261/39 E |

*Primary Examiner*—Tim R. Miles
*Attorney, Agent, or Firm*—Barnes, Kisselle, Raisch, Choate, Whittemore & Hulbert

[57] ABSTRACT

An automatic choke control which includes a housing, a bimetallic coil in the housing having an output shaft for connection to a choke to move the choke toward a closed position when the temperature of the engine is low and to move the choke toward an open position when the temperature of the engine rises, and a body of porous material impregnated with a material such as paraffin that is normally solid and becomes liquid at an elevated temperature. The body of impregnated material is mounted on the exterior of the choke control housing so that it functions as a heat sink to store thermal energy in the solid material converting the material to a liquid.

1 Claim, 3 Drawing Figures

INSULATED CAP AND HEAT SINK FOR AUTOMATIC CHOKE CONTROL

This invention relates to automatic choke controls.

BACKGROUND AND SUMMARY OF THE INVENTION

In automatic choke controls, a bimetallic coil is commonly utilized and is connected to the automatic choke to tend to hold the choke in closed position when the engine is cold and to tend to open the choke when the engine temperature rises. Such automatic choke controls are shown, for example, in U.S. Pat. No. 3,093,999, 4,050,427, 4,083,336 and 4,038,955. The control may include heaters and other electrical controls associated with the bimetallic coil.

In such choke control systems, if the bimetallic coil tends to cool faster than the engine, a condition is reached where the system provides fast idle and enrichment when it is not required by the engine. Such a condition can occur most often after the engine has been shut off and allowed to cool for 15–60 minutes. The condition tends to be more severe where an electrically heated choke system is provided as contrasted to the air or water heated choke control system.

It has heretofore been suggested that heat sinks be provided in the housing of the choke control, as shown for example, in U.S. Pat. Nos. 4,058,097 and 4,218,406. Such control systems require a specially constructed and designed housing.

Accordingly, among the objectives of the present invention are to provide a choke control system wherein the advantages of a heat sink are achieved without specially designing the choke control housing; which can be adapted to more conventional choke controls without a heat sink and which will effectively provide the desired result at minimal cost.

In accordance with the invention, a body of porous material is provided which is impregnated with a material such as paraffin that is normally solid and becomes liquid at an elevated temperature. The body is retained on the exterior of the choke control housing, preferably by a cap, so that it functions as a heat sink to store thermal energy in the solid material converting the material to a liquid.

DESCRIPTION

Figure 1:
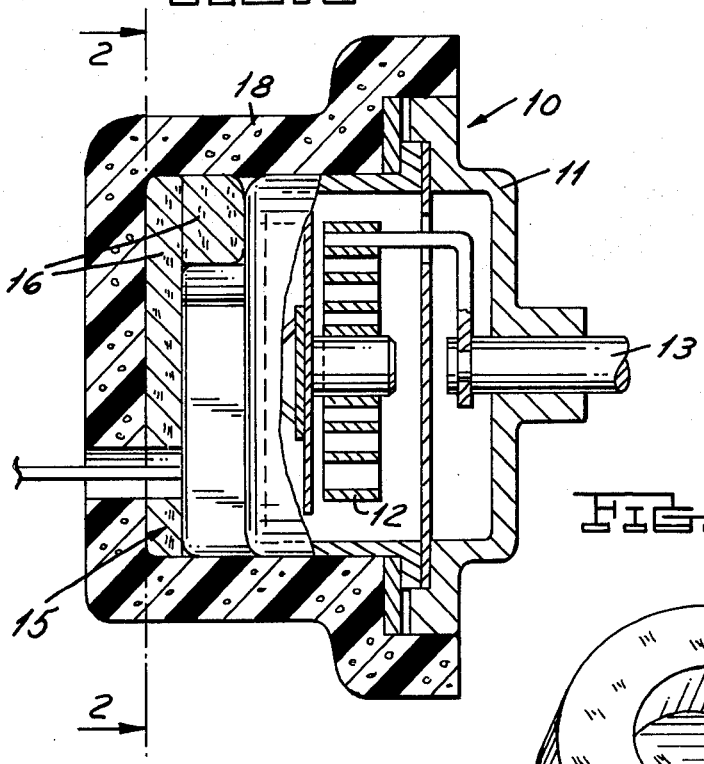
FIG. 1 is a longitudinal sectional view through an automatic choke control embodying the invention.
Figure 3:
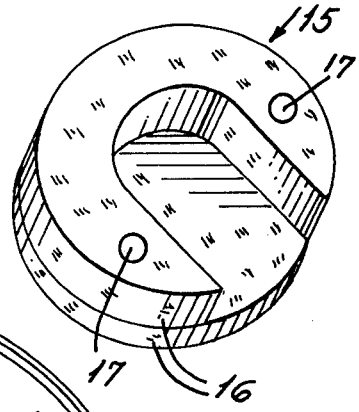
FIG. 3 is a perspective view of the heat sink portion of the automatic choke control.
Figure 2:
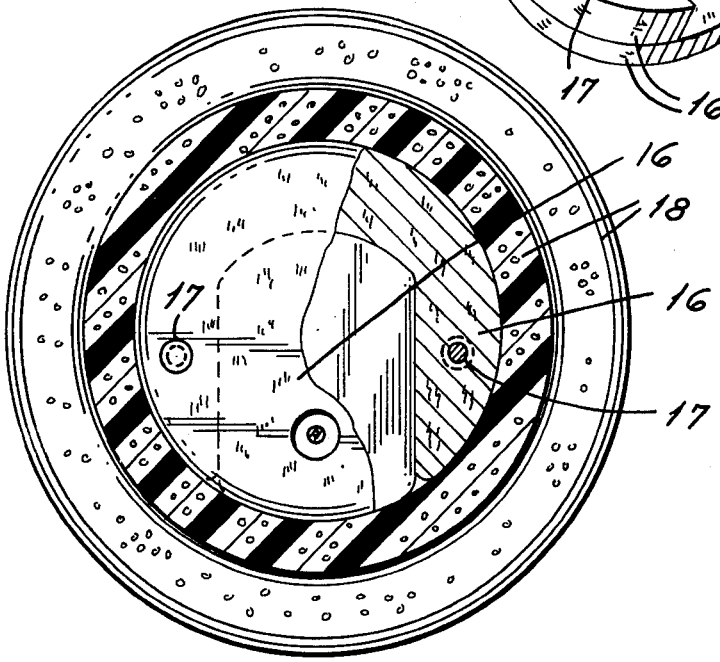
FIG. 2 is a sectional view taken along the line 2—2 in FIG. 1.

Referring to FIG. 1, the automatic choke control 10 comprises a plastic housing 11 that includes a bimetallic element 12 connected to a shaft 13 which, in turn, actuates to the choke and the fast idle mechanism of a carburetor through a linkage (not shown). Heaters and other controls for the bimetallic coil 12 may be included in accordance with conventional practice such as shown in U.S. Pat. Nos. 4,050,427, 4,083,336 and 4,038,955 which are incorporated herein by reference.

In accordance with the invention, a heat sink 15 is provided on the exterior of the housing 11 and comprises one or more layers 16 of a porous material such as felt, impregnated with a material that changes from a solid to a liquid as the temperature changes. The satisfactory material may comprise paraffin. The layers 16 are held in assembled relation by a fastener 17 such as a rivet or staple.

The heat sink 15 is enclosed in a cap 18 that substantially surrounds the major portion of the housing 11 and is frictionally held on the housing 11 or retained by a suitable clip or mounting bracket. The cap is preferably made of a foam plastic material.

When the engine is cold, the paraffin material is retained in the heat sink in a solid state. As the engine temperature rises, the automatic choke control functions to heat the bimetallic coil to open the choke in a conventional manner. When the temperature of the engine reaches operating temperature, the heat sink operates to absorb heat by change of state of the paraffin from a solid to a liquid. The paraffin material in the liquid state is retained by the felt, eliminating any need to seal the chamber in which it is located.

When the engine operation is interrupted and there is a tendency for the automatic choke to lose temperature at a greater rate than the engine, the heat of the melted material in the heat sink functions to transfer heat to the bimetallic coil at a low rate through the housing 11 to the bimetallic coil 12 so that there will be less tendency for the engine to operate at fast idle or in an enriched condition when the engine is restarted.

It can thus be seen that there has been provided a simple and inexpensive manner for converting a conventional automatic choke control system to incorporate a heat sink and thereby obtain the advantages of the heat sink.

I claim:

1. In an automatic choke control which includes a housing having a side wall and an end wall, a bimetallic coil in said housing having an output linkage for connection to a choke to move the choke toward a closed position when the temperature of the engine is low and to move the choke toward an open position when the temperature of the engine rises, the improvement comprising a body of porous material impregnated with a material such as paraffin that is normally solid and becomes liquid at an elevated temperature, said body engaging said end wall of said housing, an insulating cap of foam plastic material substantially surrounding the major portion of said housing overlies the body and frictionally engaging said housing for retaining said body on the exterior of the end wall of said housing so that it functions as a heat sink to store thermal energy in the solid material converting the material to a liquid.

* * * * *